US011257415B2

(12) United States Patent
Pyo et al.

(10) Patent No.: US 11,257,415 B2
(45) Date of Patent: Feb. 22, 2022

(54) DISPLAY DEVICE

(71) Applicant: Samsung Display Co., Ltd., Yongin-si (KR)

(72) Inventors: Si Beak Pyo, Yongin-si (KR); Seung Kyu Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/034,708

(22) Filed: Sep. 28, 2020

(65) Prior Publication Data

US 2021/0272501 A1 Sep. 2, 2021

(30) Foreign Application Priority Data

Mar. 2, 2020 (KR) ..... 10-2020-0026164

(51) Int. Cl.
*G09G 3/20* (2006.01)
*G09G 3/32* (2016.01)

(52) U.S. Cl.
CPC ..... *G09G 3/2007* (2013.01); *G09G 3/32* (2013.01); *G09G 2310/027* (2013.01); *G09G 2310/0267* (2013.01); *G09G 2310/08* (2013.01); *G09G 2320/0626* (2013.01); *G09G 2330/021* (2013.01)

(58) Field of Classification Search
CPC ..... G09G 3/2007; G09G 2310/0267; G09G 3/32; G09G 2330/021; G09G 2320/0626; G09G 2310/08; G09G 2310/027
See application file for complete search history.

(56) References Cited

U.S. PATENT DOCUMENTS

| | | | | |
|---|---|---|---|---|
| 9,318,061 | B2 * | 4/2016 | Chang | G09G 3/3607 |
| 9,368,067 | B2 | 6/2016 | Kim et al. | |
| 10,089,959 | B2 * | 10/2018 | Jangda | G09G 3/3208 |
| 10,553,146 | B2 * | 2/2020 | Pyo | G09G 3/2077 |
| 2016/0019849 | A1 * | 1/2016 | Chang | G09G 5/10 345/690 |
| 2016/0314760 | A1 * | 10/2016 | Jangda | G09G 3/3208 |
| 2017/0294156 | A1 * | 10/2017 | Pyo | G09G 3/2003 |
| 2021/0272501 | A1 * | 9/2021 | Pyo | G09G 3/2007 |

FOREIGN PATENT DOCUMENTS

KR 10-2020-0015292 A 2/2020

* cited by examiner

*Primary Examiner* — Michael J Jansen, II
(74) *Attorney, Agent, or Firm* — Lewis Roca Rothgerber Christie LLP

(57) ABSTRACT

A display device includes a gray scale converter to receive input gray scale values, calculate an output load value that is smaller than an input load value when the input load value calculated from the input gray scale values is larger than a start current limit value, and convert the input gray scale values into converted gray scale values to correspond to the output load value, and a data driver to provide data voltages based on the converted gray scale values, wherein, when the input load value is between the start current limit value and a first current limit value, there is a first increase rate of the output load value for the input load value, and wherein, when the input load value is between the first current limit value and a maximum value of the input load value, there is a second increase rate of the output load value.

18 Claims, 17 Drawing Sheets

FIG. 14

| DBV=2500Nits | CV1 | | | CV2 | | | CV4 | | |
|---|---|---|---|---|---|---|---|---|---|
| | LUMINANCE [Nits] | GRAY SCALE | Vsat [V] | LUMINANCE [Nits] | GRAY SCALE | Vsat [V] | LUMINANCE [Nits] | GRAY SCALE | Vsat [V] |
| OPRi4=100% | 1950 | 255.000 | −7.5 | 1200 | 182.625 | −4.8 | 1200 | 182.625 | −4.8 |
| OPRi6=80% | 2037 | 255.000 | −7.2 | 1460 | 199.625 | −5.4 | 1241 | 185.375 | −4.8 |
| OPRi3=65% | 2120 | 255.000 | −6.8 | 1674 | 212.500 | −5.6 | 1378 | 194.500 | −4.8 |
| OPRi5=40% | 2290 | 255.000 | −5.9 | 2063 | 233.625 | −5.5 | 1812 | 220.250 | −4.8 |
| OPRi2=15% | 2500 | 255.000 | −4.8 | 2500 | 255.000 | −4.8 | 2500 | 255.000 | −4.8 |
| ELVSS | −7.5V | | | −5.6V | | | −4.8V | | |

FIG. 16

| DBV \ OPRi | 100% | 80% | 65% | 40% | 15% | 0% | ELVSS[V] |
|---|---|---|---|---|---|---|---|
| 2500Nits | 182.625 | 185.375 | 194.500 | 220.250 | 255.000 | 255.000 | −4.8 |
| 1800Nits | 189.500 | 201.000 | 212.125 | 235.000 | 255.000 | 255.000 | −4.8 |
| 1200Nits | 210.750 | 222.250 | 231.750 | 248.875 | 255.000 | 255.000 | −4.8 |
| 1000Nits | 220.250 | 230.625 | 239.000 | 253.750 | 255.000 | 255.000 | −4.3 |
| 650Nits | 239.000 | 246.500 | 252.375 | 255.000 | 255.000 | 255.000 | −3.8 |
| 300Nits | 255.000 | 255.000 | 255.000 | 255.000 | 255.000 | 255.000 | −3.8 |
| 100Nits | 255.000 | 255.000 | 255.000 | 255.000 | 255.000 | 255.000 | −3.2 |
| 60Nits | 255.000 | 255.000 | 255.000 | 255.000 | 255.000 | 255.000 | −3.2 |
| 30Nits | 255.000 | 255.000 | 255.000 | 255.000 | 255.000 | 255.000 | −3.2 |
| 15Nits | 255.000 | 255.000 | 255.000 | 255.000 | 255.000 | 255.000 | −3.2 |
| 10Nits | 255.000 | 255.000 | 255.000 | 255.000 | 255.000 | 255.000 | −3.2 |
| 4Nits | 255.000 | 255.000 | 255.000 | 255.000 | 255.000 | 255.000 | −3.2 |

DISPLAY DEVICE

CROSS-REFERENCE TO RELATED APPLICATION

This application claims priority to, and the benefit of, Korean patent application number 10-2020-0026164 filed on Mar. 2, 2020, the entire disclosure of which is incorporated herein in its entirety by reference.

BACKGROUND

1. Field

Various embodiments of the present disclosure relate to a display device.

2. Description of Related Art

With the development of information technology, the importance of a display device that is a connection medium between a user and information has been emphasized. Owing to the importance of the display device, the use of various display devices, such as a liquid crystal display device, an organic light-emitting display device, and a plasma display device, has increased.

To provide a high-quality image to consumers, various technologies have been proposed. For example, HDR (High Dynamic Range) technology can provide a high-quality image to a user by causing a bright area of a screen to emit light at ultra high luminance to thereby provide more clear contrast with a dark area of the screen.

However, it may be difficult or undesirable for an entirety of an area to emit light at ultra-high luminance in an image in which the entire area of the screen is a high gray scale, in terms of power consumption and stability.

SUMMARY

Various embodiments of the present disclosure are directed to a display device capable of stably providing an image of ultra-high luminance.

One or more embodiments of the present disclosure may provide a display device including pixels, a gray scale converter configured to receive input gray scale values for the pixels, calculate an output load value that is smaller than an input load value when the input load value calculated from the input gray scale values is larger than a start current limit value, and convert the input gray scale values into converted gray scale values to correspond to the output load value, and a data driver configured to provide data voltages based on the converted gray scale values to the pixels, wherein, when the input load value is larger than the start current limit value and is smaller than a first current limit value, an increase rate of the output load value for the input load value is a first increase rate, wherein, when the input load value is larger than the first current limit value and is smaller than a maximum value of the input load value, an increase rate of the output load value for the input load value is a second increase rate that is different than the first increase rate.

The gray scale converter may be further configured to receive a maximum luminance value, and to determine a magnitude of the output load value corresponding to the input load value based on a magnitude of the maximum luminance value.

The gray scale converter may be further configured to determine that the larger the maximum luminance value is, the smaller the output load value corresponding to the input load value is.

The gray scale converter may be configured to reduce a magnitude of a power voltage that is supplied to the pixels in common as the maximum luminance value increases.

The gray scale converter may be configured to maintain a magnitude of a power voltage, regardless of an increase or decrease in the input load value, when the maximum luminance value is maintained.

The gray scale converter may include a memory that is configured to store the start current limit value, the first current limit value, a first output load value corresponding to the first current limit value, and a maximum output load value.

The gray scale converter may further include an output load calculator that is configured to calculate the output load value corresponding to the input load value, by interpolating the output load value corresponding to the start current limit value and the first output load value, when the input load value is larger than the start current limit value and is smaller than the first current limit value.

The output load calculator may be further configured to calculate the output load value corresponding to the input load value, by interpolating the first output load value and the maximum output load value, when the input load value is larger than the first current limit value and is smaller than the maximum value of the input load value.

The output load calculator may be further configured to determine that the larger a maximum luminance value is, the smaller the output load value corresponding to the input load value is.

The gray scale converter may further include a converted gray scale calculator that is configured to convert the input gray scale values into the converted gray scale values to correspond to the output load value, and to convert the converted gray scale values to be smaller than or equal to the output load value.

One or more embodiments of the present disclosure may provide a display device including pixels, a gray scale converter configured to receive input gray scale values for the pixels, calculate an output load value that is smaller than an input load value when the input load value calculated from the input gray scale values is larger than a start current limit value, and convert the input gray scale values into converted gray scale values to correspond to the output load value, and a data driver configured to provide data voltages based on the converted gray scale values to the pixels, wherein, when the input load value is larger than the start current limit value and is smaller than a second current limit value, an increase rate of the output load value for the input load value is a third increase rate, wherein, when the input load value is larger than the second current limit value and is smaller than a first current limit value, an increase rate of the output load value for the input load value is a fourth increase rate, wherein, when the input load value is larger than the first current limit value and is smaller than a third current limit value, an increase rate of the output load value for the input load value is a fifth increase rate, wherein, when the input load value is larger than the third current limit value and is smaller than a maximum value of the input load value, an increase rate of the output load value for the input load value is a sixth increase rate, and wherein the third increase rate, the fourth increase rate, the fifth increase rate, and the sixth increase rate are different from each other.

The gray scale converter may include a memory that is configured to store the start current limit value, the first current limit value, a first output load value corresponding to the first current limit value, a second output load value corresponding to the second current limit value, a third output load value corresponding to the third current limit value, and a maximum output load value.

The gray scale converter may further include an output load calculator that is configured to calculate the output load value corresponding to the input load value, by interpolating the output load value corresponding to the start current limit value and the second output load value, when the input load value is larger than the start current limit value and is smaller than the second current limit value.

The output load calculator may be configured to calculate the output load value corresponding to the input load value by interpolating the second output load value and the first output load value when the input load value is larger than the second current limit value and is smaller than the first current limit value, interpolating the first output load value and the third output load value when the input load value is larger than the first current limit value and is smaller than the third current limit value, and interpolating the third output load value and the maximum output load value when the input load value is larger than the third current limit value and is smaller than the maximum value of the input load value.

The output load calculator may be configured to determine that the larger a maximum luminance value is, the smaller the output load value corresponding to the input load value is.

The gray scale converter may further include a converted gray scale calculator that is configured to convert the input gray scale values into the converted gray scale values to correspond to the output load value, and convert the converted gray scale values to be smaller than or equal to the output load value.

The memory may be further configured to store a reference power voltage value.

The output load calculator may be configured to determine a magnitude of a power voltage that is provided to the pixels in common by providing the power voltage value corresponding to the maximum luminance value, and a power voltage value by adding a power voltage offset value corresponding to the maximum luminance value to the reference power voltage value.

The output load calculator may be configured to reduce the magnitude of the power voltage value as the maximum luminance value increases.

The output load calculator may be configured to maintain the magnitude of the power voltage, regardless of an increase or decrease in the input load value, when the maximum luminance value is maintained.

BRIEF DESCRIPTION OF THE DRAWINGS

FIGS. 12 to 14 are diagrams illustrating a gray scale converter in accordance with one or more embodiments of the present disclosure.

FIGS. 15 and 16 are diagrams illustrating a gray scale converter in accordance with one or more embodiments of the present disclosure.

DETAILED DESCRIPTION

Figure 1:
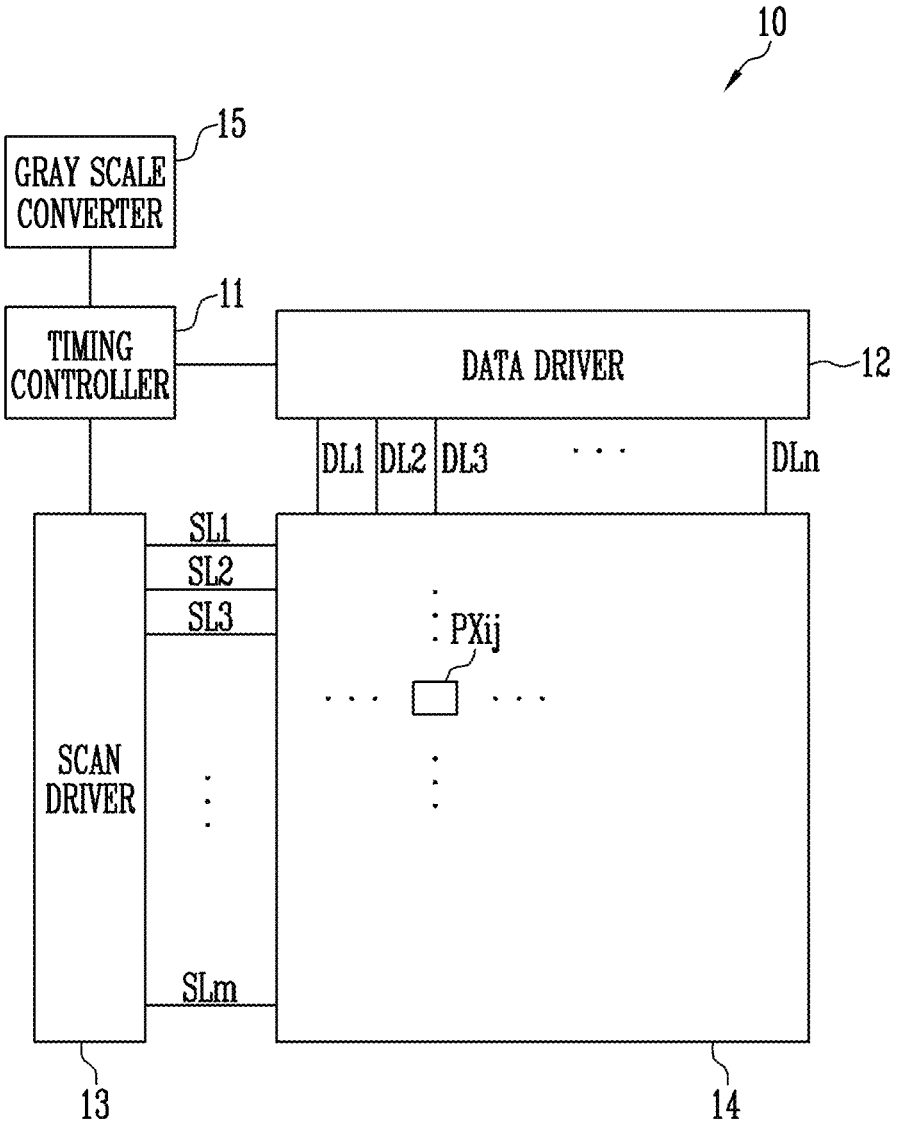
FIG. 1 is a diagram illustrating a display device in accordance with one or more embodiments of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described.

Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing, and the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

When one or more embodiments may be implemented differently, a specific process order may be performed differently from the described order. For example, two consecutively described processes may be performed substantially at the same time or performed in an order opposite to the described order.

Also, any numerical range disclosed and/or recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112(a) and 35 U.S.C. § 132(a).

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate.

Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a diagram illustrating a display device in accordance with one or more embodiments of the present disclosure.

Referring to FIG. 1, the display device 10 in accordance with one or more embodiments of the present disclosure may include a timing controller 11, a data driver 12, a scan driver 13, a display area/pixel component 14, and a gray scale converter 15.

The timing controller 11 may receive input gray scale values and control signals for each frame from an external processor. Here, the input gray scale values for a frame may be referred to as frame data. The timing controller 11 may provide (e.g., to the data driver 12, the scan driver 13, etc.), control signals suitable for specifications of the respective components to express frames.

The gray scale converter 15 may provide converted gray scale values obtained by converting the input gray scale values. The timing controller 11 may provide the converted gray scale values to the data driver 12. The gray scale converter 15 may be formed of an integrated IC that is integrated with the timing controller 11, or a separate IC. Furthermore, the gray scale converter 15 may be implemented in software in the timing controller 11. Furthermore, the gray scale converter 15 may be formed of an integrated IC that is integrated with the data driver 12, or a separate IC. Furthermore, the gray scale converter 15 may be implemented in software in the data driver 12.

The data driver 12 may generate data voltages to be provided to data lines DL1, DL2, DL3, and DLn (here, n may be an integer that is greater than 0) using the converted gray scale values and the control signals. In other words, the data driver 12 may provide data voltages based on the converted gray scale values to pixels of the display area 14. For example, the data driver 12 may sample the converted gray scale values using a clock signal, and may apply data voltages corresponding to the converted gray scale values to the data lines DL1 to DLn on a pixel row basis. A pixel row may refer to a group of the pixels that are commonly coupled to a single scan line.

The scan driver 13 may receive a clock signal, a scan start signal, or other signals from the timing controller 11, and may generate scan signals to be provided to the scan lines SL1, SL2, SL3, and SLm (here, m may be an integer greater than 0).

The scan driver 13 may sequentially supply scan signals having a turn-on level pulse to the scan lines SL1 to SLm. The scan driver 13 may be configured in the form of a shift register, and may include a plurality of scan stages. The scan driver 13 may generate scan signals by sequentially transmitting the turn-on level pulse of the scan start signal to a subsequent scan stage under control of the clock signal.

The display area 14 includes pixels. Each pixel (e.g., pixel PXij, where i and j each may be respective integer that is greater than 0) may be coupled to a corresponding data line and a corresponding scan line. The pixel PXij may refer to a pixel that has a scan transistor (e.g., transistor T2 in FIG. 2) that is coupled to an i-th scan line and to a j-th data line. The pixels may be coupled in common to a first power line ELVDDL and to a second power line ELVSSL (see FIG. 2).

Figure 2:
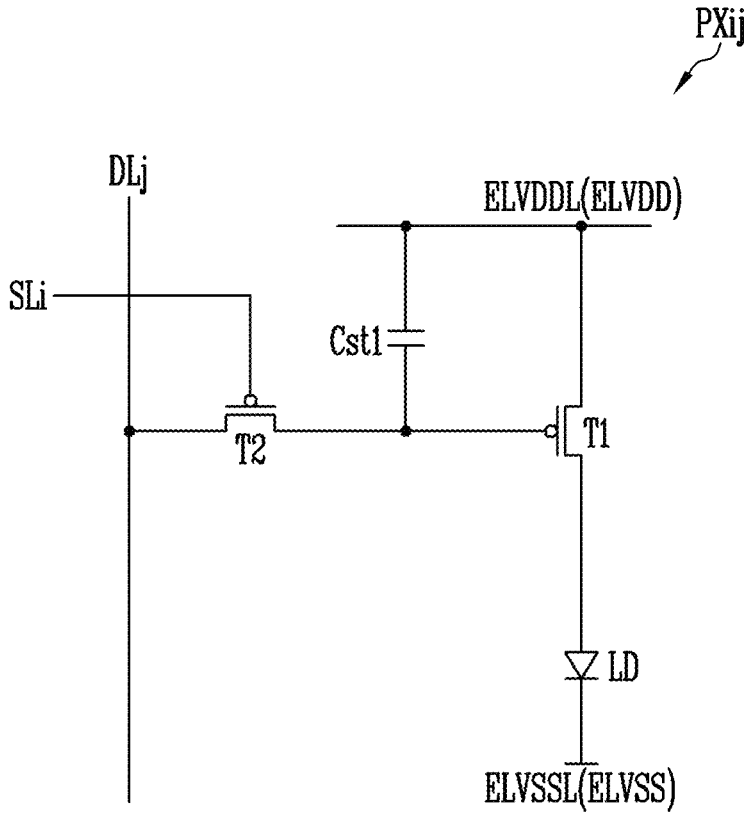
FIG. 2 is a diagram illustrating a pixel in accordance with one or more embodiments of the present disclosure.

FIG. 2 is a diagram illustrating a pixel in accordance with one or more embodiments of the present disclosure.

Referring to FIG. 2, the pixel PXij may be a pixel that emits light of a first color. Because pixels emitting light of a second color or of a third color substantially include the same components as the pixel PXij, with the exception of a light emitting diode LD, a duplicated description thereof will be omitted.

For instance, the first color may be one of red, green, and blue, the second color may be one of red, green, and blue that is other than the first color, and the third color may be may be a remaining color, which is other than the first and second colors, among red, green, and blue. Furthermore, the first to third colors may respectively use magenta, cyan, and yellow in place of red, green, and blue.

The pixel PXij may include a plurality of transistors T1 and T2, a storage capacitor Cst1, and a light emitting diode LD. Although transistors may be illustrated as a P-type transistor (e.g. a PMOS transistor), a pixel circuit having the same function may be formed with one or more N-type transistors (e.g. an NMOS transistor).

A second transistor T2 is configured such that a gate electrode thereof is coupled to a scan line SLi, a first electrode thereof is coupled to a data line DLj, and a second electrode thereof is coupled to a gate electrode of a first transistor T1. The second transistor T2 may be referred to as a scan transistor, a switching transistor, etc.

The first transistor T1 is configured such that a gate electrode thereof is coupled to a second electrode of the second transistor T2, a first electrode thereof is coupled to the first power line ELVDDL, and a second electrode thereof is coupled to an anode of the light emitting diode LD. The first transistor T1 may be referred to as a driving transistor.

The storage capacitor Cst1 couples the first electrode of the first transistor T1 and the gate electrode of the first transistor T1.

The anode of the light emitting diode LD is coupled to the second electrode of the first transistor T1, and a cathode thereof is coupled to the second power line ELVSSL. The light emitting diode LD may be an element that emits light of a wavelength corresponding to the first color. The light emitting diode LD may be an organic light emitting diode, an inorganic light emitting diode, a quantum dot/well light emitting diode, etc. Although only one light emitting diode LD is illustrated, a plurality of sub-light-emitting diodes may be coupled in series, in parallel, or in series-parallel to replace the light emitting diode LD in other embodiments.

If the scan signal of the turn-on level (e.g., of a low level) is supplied to the gate electrode of the second transistor T2 through the scan line SLi, the second transistor T2 couples the data line DLj and the first electrode of the storage capacitor Cst1. Thus, a voltage due to a difference between a data voltage applied through the data line DLj and a first power voltage ELVDD of the first power line ELVDDL is recorded in the storage capacitor Cst1.

The first transistor T1 causes a driving current determined according to a voltage recorded in the storage capacitor Cst1 to flow from the first power line ELVDDL to the second power line ELVSSL. The light emitting diode LD may emit light at luminance depending on the amount or magnitude of the driving current.

According to one or more embodiments, the first transistor T1 may be driven in a saturated state. As the voltage applied to the gate electrode of the first transistor T1 is reduced, the amount of driving current may be increased. In other words, the first transistor T1 may act as a current source. A condition for driving the first transistor T1 in the saturated state may be expressed by the following Equation 1.

$$Vds < Vgs - Vth \quad \text{[Equation 1]}$$

Here, Vds is a drain-source voltage difference of the first transistor T1, Vgs is a gate-source voltage difference of the first transistor T1, and Vth is a threshold voltage of the first transistor T1. Vth may be less than zero.

The light emitting diode LD may emit light at higher luminance as the amount of the driving current increases. Therefore, to display a high gray scale, a reduced gate voltage may be suitable (e.g., reduced as compared to the gate voltage for displaying a low gray scale). Furthermore, according to Equation 1, a reduced drain voltage corresponding the reduced gate voltage may result. That is, to display a high gray scale, a smaller second power voltage ELVSS may be suitable (e.g., smaller in magnitude as compared to a second power voltage for displaying the low gray scale). Furthermore, the larger an input load value is (to be described later), the larger a corresponding voltage drop is. Hence, as the input load value is increased, a smaller second power voltage ELVSS may be used.

If the second power voltage ELVSS is not sufficiently small, poor display may occur. If the second power voltage ELVSS is too small, excessive power consumption may result. Furthermore, it may be difficult or undesirable to implement (e.g., in hardware) a second power voltage ELVSS that is too small. Thus, the second power voltage ELVSS may be set to be suitable for target emission luminance of the light emitting diode LD.

According to Equation 1, an increased source voltage corresponding to the reduced gate voltage may be used. In other words, the following embodiments may be implemented by adjusting the rising degree of the first power voltage ELVDD. Hereinafter, for the convenience of description, description will be made based on the second power voltage ELVSS.

FIGS. 3 to 8 are diagrams illustrating a gray scale converter in accordance with one or more embodiments of the present disclosure.

Figure 3:
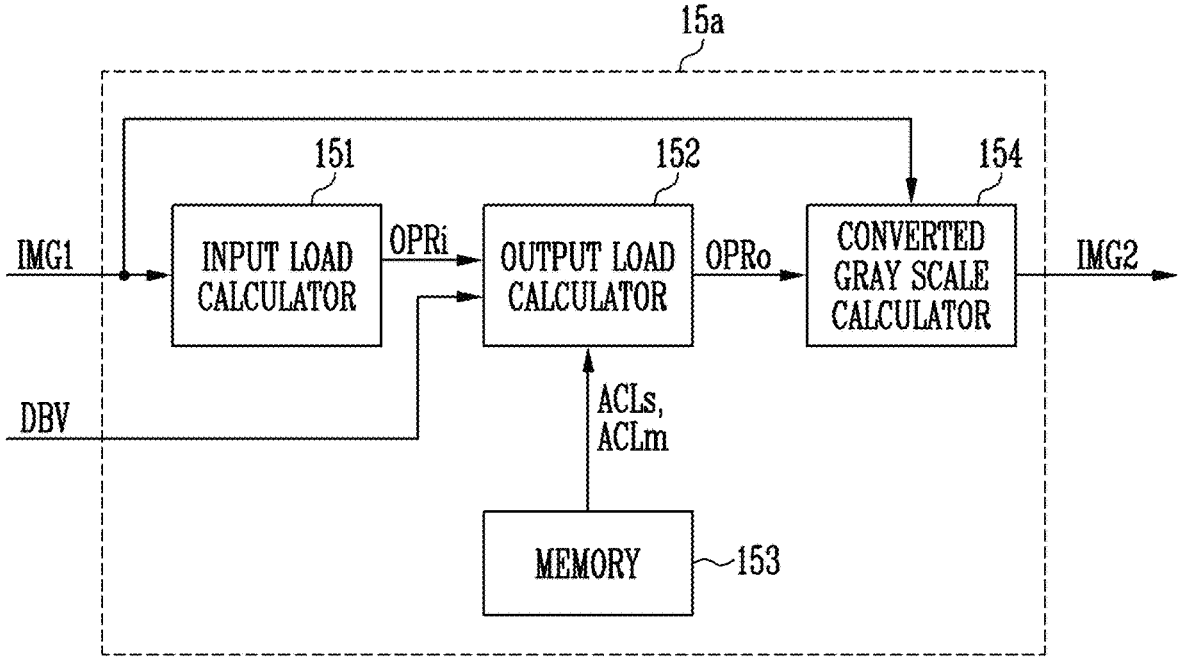
FIGS. 3 to 8 are diagrams illustrating a gray scale converter in accordance with one or more embodiments of the present disclosure.
Figure 4:
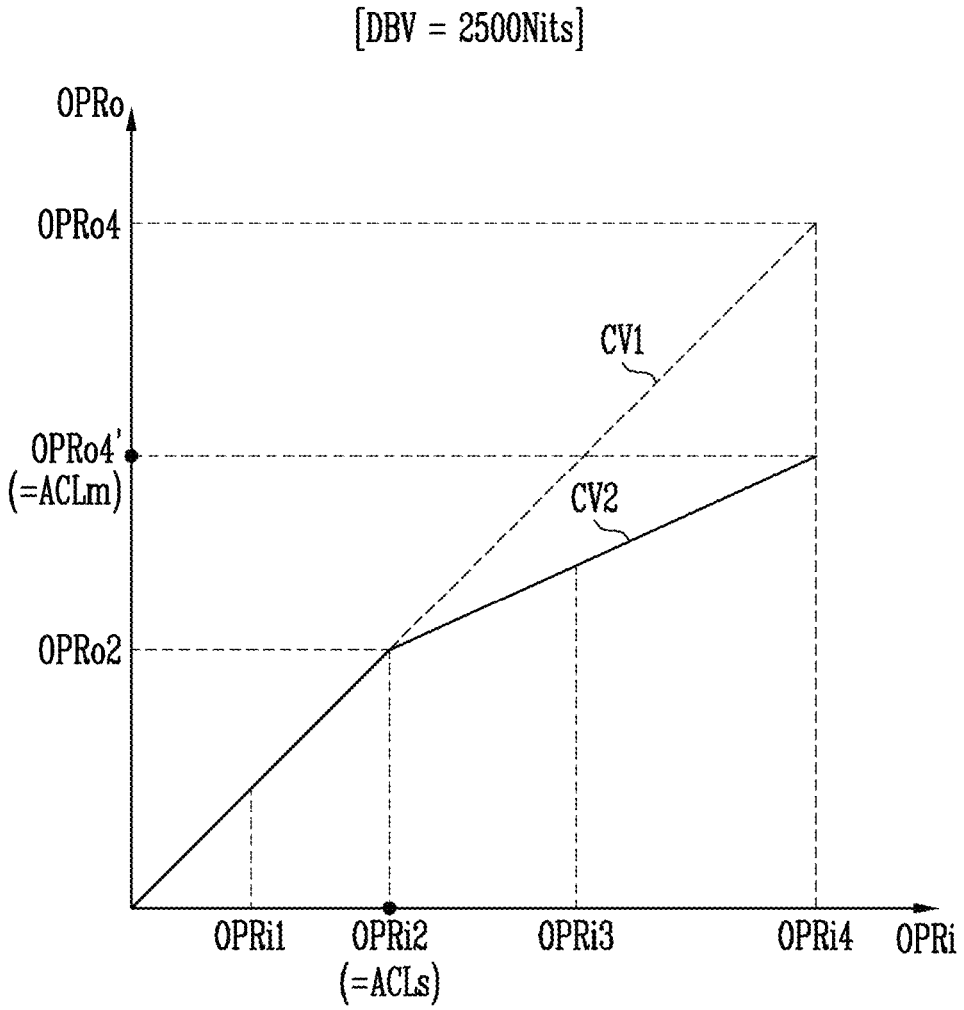

Referring to FIG. 3, the gray scale converter 15*a* in accordance with one or more embodiments of the present disclosure may include an input load calculator 151, an output load calculator 152, a memory 153, and a converted gray scale calculator 154.

The gray scale converter 15*a* may receive input gray scale values IMG1 for the pixels. The gray scale converter 15*a* may calculate an output load value OPRo that is smaller than an input load value OPRi when the input load value OPRi calculated from the input gray scale values IMG1 is greater than a start current limit value ACLs. The gray scale converter 15*a* may provide the same output load value OPRo as the input load value OPRi when the input load value OPRi is smaller than the start current limit value ACLs. The gray scale converter 15*a* may convert input gray scale values IMG1 into converted gray scale values IMG2 to correspond to the output load value OPRo. The input gray scale values IMG1 may be frame data for one frame (one image screen). The converted gray scale values IMG2 may be converted frame data for a corresponding frame.

The input load calculator 151 may calculate the input load value OPRi based on the input gray scale values IMG1. For example, the input load value OPRi may be an average value of the input gray scale values IMG1 (see Equation 2 below). In one or more embodiments, the input load value OPRi may be a sum of the input gray scale values IMG1.

$$OPRi=(RGs*WR+GGs*WG+BGs*WB)/GN \quad \text{[Equation 2]}$$

Here, RGs is the sum of gray scale values of the first color (e.g. red) among the input gray scale values IMG1, GGs is the sum of gray scale values of the second color (e.g. green) among the input gray scale values IMG1, and BGs is the sum of gray scale values of the third color (e.g. blue) among the input gray scale values IMG1. WR, WG, and WB are weights for respective colors. GN is a number of the input gray scale values IMG1.

For the convenience of description, it is assumed in one or more examples below that WR, WG, and WB each are 1. Furthermore, for the convenience of description, it is assumed in one or more examples below that each of the input gray scale values IMG1 is one of 0 to 255. 0 may be a black gray scale value, and 255 may be a white gray scale value. In this case, the input load value OPRi may have a range from about 0 to about 255. In the following examples, for the convenience of description, the input load value OPRi may be expressed as a percentage (%). For instance, if the input load value OPRi is 0, it may be expressed as 0%. If the input load value OPRi is 255, it may be expressed as 100%.

The memory 153 may store (e.g., may previously store) the start current limit value ACLs and a maximum output load value ACLm.

The output load calculator 152 may provide the same output load value OPRo as the input load value OPRi when the input load value OPRi is smaller than the start current limit value ACLs.

The output load calculator 152 may calculate the output load value OPRo corresponding to the input load value OPRi, by interpolating the output load value OPRo2 (e.g., see FIG. 4) corresponding to the start current limit value ACLs and the maximum output load value ACLm, when the input load value OPRi is larger (e.g., larger in magnitude) than the start current limit value ACLs and is smaller (e.g., smaller in magnitude) than a maximum value OPRi4 of the input load value OPRi. In this case, the output load value OPRo2 may be the same as the start current limit value ACLs. In this case, the output load value OPRo for the input load value OPRi may follow a second graph CV2.

The output load calculator 152 may receive a maximum luminance value DBV. The maximum luminance value DBV may be a value that is set by a user. The user may increase the maximum luminance value DBV when he or she wants to watch a brighter image. Furthermore, the user may reduce the maximum luminance value DBV when he or she wants to watch a darker image. Furthermore, the maximum luminance value DBV may be automatically set by an algorithm associated with an illuminance sensor.

The maximum luminance value DBV may be a luminance value of light emitted from pixels corresponding to a maximum gray scale. For example, it may be the luminance of white light generated when all of the pixels of the display area 14 emit light to correspond to a white gray scale value. The units of the luminance may be Nits. The maximum luminance value DBV may be referred to as a display brightness value.

The display area 14 may display a partially (e.g., a spatially partial) dark or bright image, while the maximum luminance of the image is limited to the maximum luminance value DBV. Although the maximum luminance value may vary from product to product, for example, the maximum value of the maximum luminance value DBV may be 2500 Nits, and the minimum value thereof may be 4 Nits. Because the data voltages for a specific gray scale vary with the maximum luminance value DBV, the emission luminance of the pixel PXij is also changed.

The output load calculator 152 may determine the magnitude of the output load value OPRo corresponding to the input load value OPRi based on the magnitude of the maximum luminance value DBV. For instance, the output load calculator 152 may reduce the magnitude of the output load value OPRo corresponding to the input load value OPRi as the maximum luminance value DBV increases. For the convenience of description, referring to FIGS. 4 to 8, it is assumed that the maximum luminance value DBV is 2500 Nits in one or more of the following examples.

When the output load calculator 152 provides the same output load value OPRo as the input load value OPRi, the output load value OPRo for the input load value OPRi may follow a first graph CV1. In the range after the start current limit value ACLs, the slope of the second graph CV2 may be smaller than the slope of the first graph CV1. That is, an increase rate of the output load value OPRo for the input load value OPRi according to the second graph CV2 may be smaller than an increase rate according to the first graph CV1.

According to the first graph CV1, the output load value OPRo corresponding to the maximum value OPRi4 of the input load value OPRi may be the output load value OPRo4. For instance, the maximum value OPRi4 and the output load value OPRo4 each may be 255.

According to the second graph CV2, the output load value OPRo corresponding to the maximum value OPRi4 of the input load value OPRi may be the output load value OPRo4'. For instance, the maximum value OPRi4 may be 255, and the output load value OPRo4' may be about 182.625. For instance, the maximum output load value ACLm may be about 182.625, which may be previously stored in the memory 153.

The converted gray scale calculator 154 may convert input gray scale values IMG1 into converted gray scale values IMG2 to correspond to the output load value OPRo. The converted gray scale calculator 154 may convert the converted gray scale values IMG2 to be smaller than or equal to the output load value OPRo.

According to the first graph CV1, for example, the maximum value of the output load value OPRo may be about 255. The expression "the output load value OPRo is 255" may mean that all the pixels of the display area 14 emit light at luminance corresponding to the gray scale of 255, namely, the white gray scale. If the maximum luminance value DBV inputted into the display device 10 corresponds to about 2500 Nits (e.g., ultra-high luminance), it may be difficult or undesirable for all of the pixels of the display area 14 to emit light at 2500 Nits.

According to the second graph CV2, for example, the maximum value of the output load value OPRo may be about 182.625. Thus, the converted gray scale calculator 154 may convert the converted gray scale values IMG2 to be smaller than or equal to about 182.625. For instance, when the input gray scale values IMG1 have a range from about 0 to about 255, the input gray scale values IMG1 and the converted gray scale values IMG2 may be mapped so that the converted gray scale values IMG2 have a range from about 0 to about 182.625. For instance, when the input gray scale value is 255, the converted gray scale value may be about 182.625. For instance, when the input gray scale value is 240, the converted gray scale value may be about 171.882. Therefore, even if the maximum luminance value DBV inputted into the display device 10 is about 2500 Nits, which is the ultra-high luminance, all of the pixels of the display area 14 may stably emit light at luminance that is lower than about 2500 Nits.

Figure 5:
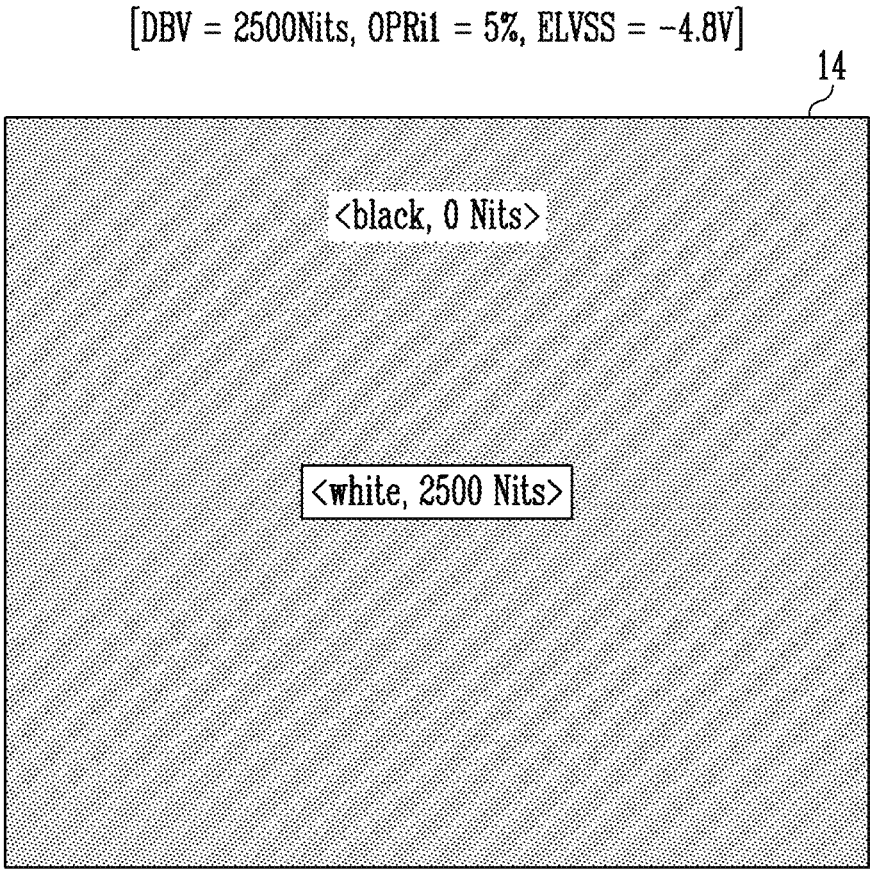

Referring to FIG. 5, when the maximum luminance value DBV is about 2500 Nits and the input load value OPRi1 is about 5%, the luminance value corresponding to the white gray scale value of the display area 14 may be about 2500 Nits. Here, the second power voltage ELVSS may be set to be about −4.8V.

Figure 6:
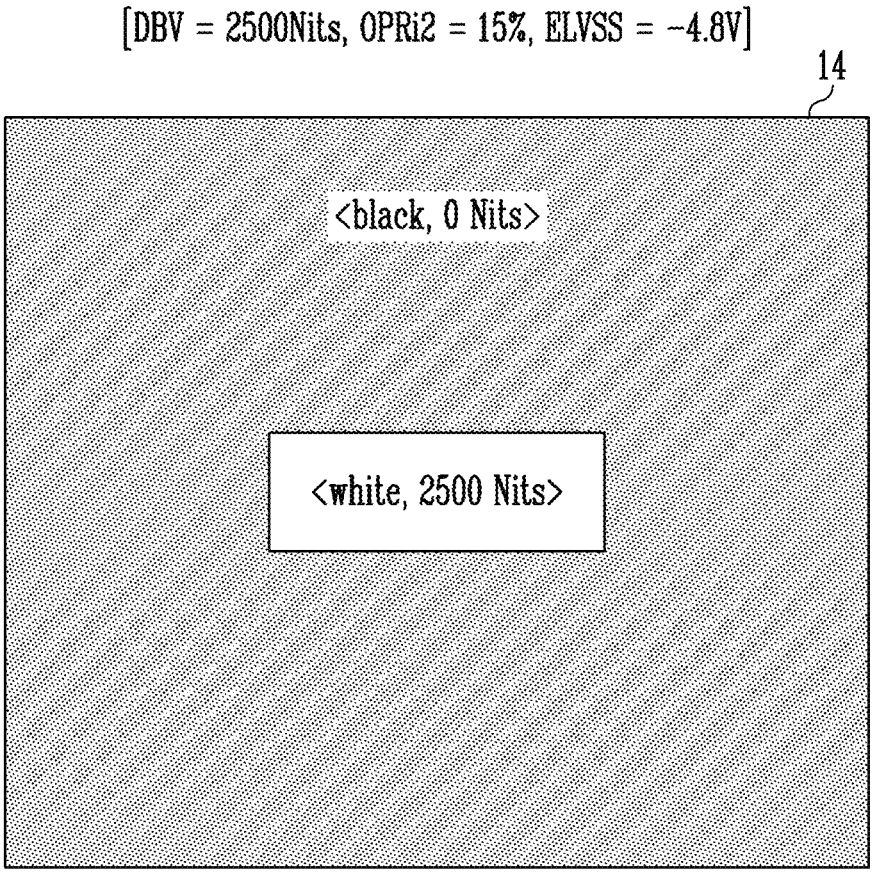

Referring to FIG. 6, when the maximum luminance value DBV is about 2500 Nits and the input load value OPRi2 is about 15%, the luminance value corresponding to the white gray scale value of the display area 14 may be about 2500 Nits. Here, the second power voltage ELVSS may be set to be about −4.8V.

Figure 7:
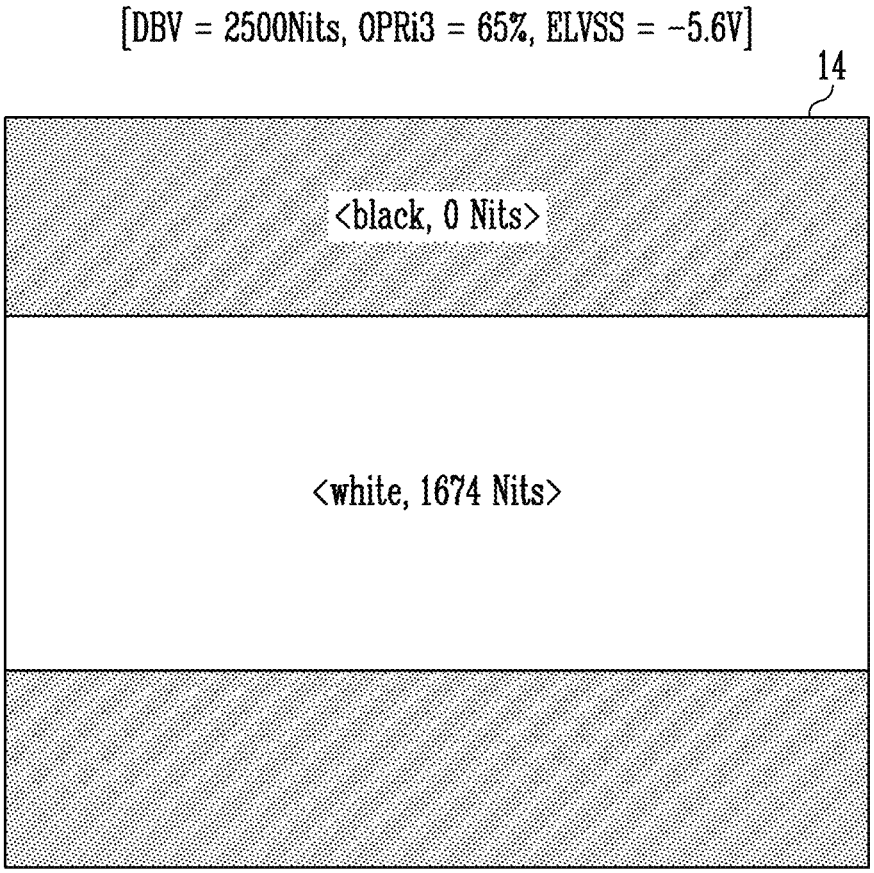

Referring to FIG. 7, when the maximum luminance value DBV is about 2500 Nits and the input load value OPRi3 is about 65%, the luminance value corresponding to the white gray scale value of the display area 14 may be about 1674 Nits. Here, the second power voltage ELVSS may be set to be about −5.6V.

Figure 8:
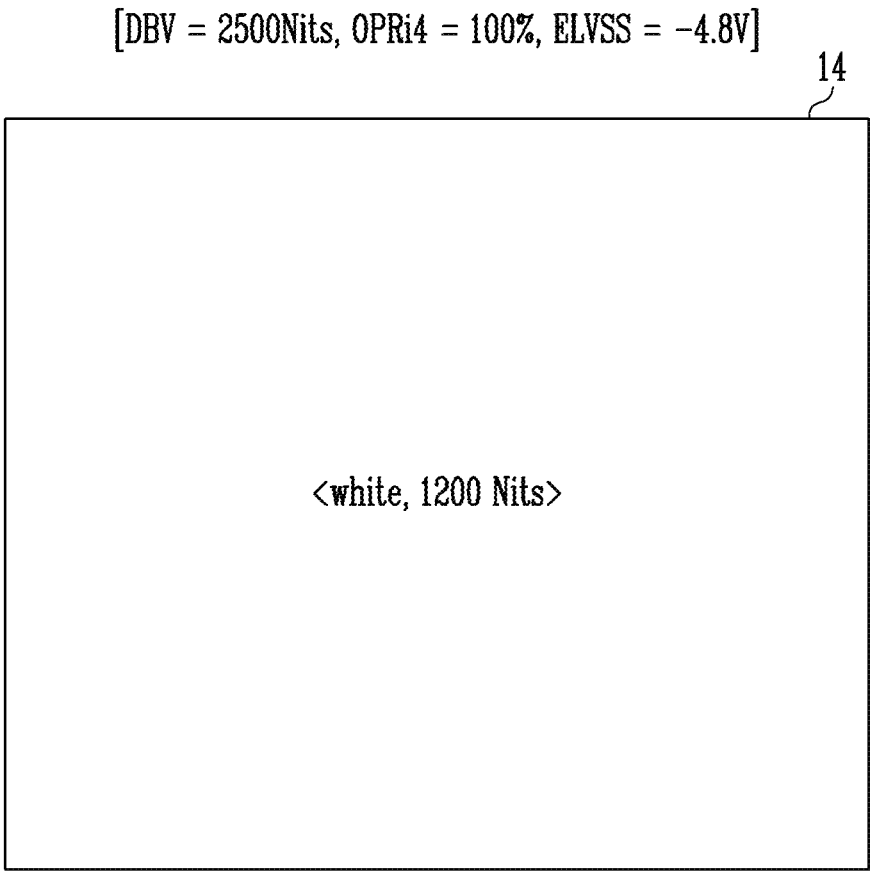

Referring to FIG. 8, when the maximum luminance value DBV is about 2500 Nits and the input load value OPRi4 is about 100%, the luminance value corresponding to the white gray scale value of the display area 14 may be about 1200 Nits. Here, the second power voltage ELVSS may be set to be about −4.8V.

According to one or more embodiments, when the input load value OPRi4 is about 100% and the input load value OPRi2 is about 15% or less, even if the second power voltage ELVSS is kept constant at about −4.8 V, all of the pixels can stably emit light. This is because the start current limit value ACLs and the maximum output load value ACLm are stored in the memory 153 to be suitable for the second power voltage ELVSS of about −4.8V (e.g., before the display device 10 is shipped).

However, in one or more embodiments, the output load value corresponding to the case where the input load value OPRi3 is about 65% might not be previously stored in the memory 153. Therefore, the output load calculator 152 uses a value obtained by interpolating the output load value OPRo2 and the maximum output load value ACLm. Thus, when the input load value OPRi3 is about 65%, the second power voltage ELVSS of about −4.8V might not be ensured. For instance, when the input load value OPRi3 is about 65%, the second power voltage ELVSS of about −5.6V may be suitable.

Because it may be difficult or undesirable to change the second power voltage ELVSS every frame, or repeatedly in consecutive frames, the display device 10 may use the second power voltage ELVSS of about −5.6V regardless of the input load value OPRi for the maximum luminance value DBV of about 2500 Nits. Thus, because other input load values OPRi1, OPRi2, and OPRi4 use the second power voltage ELVSS of about −5.6V instead of about −4.8V, unnecessary power consumption may result.

Figure 9:
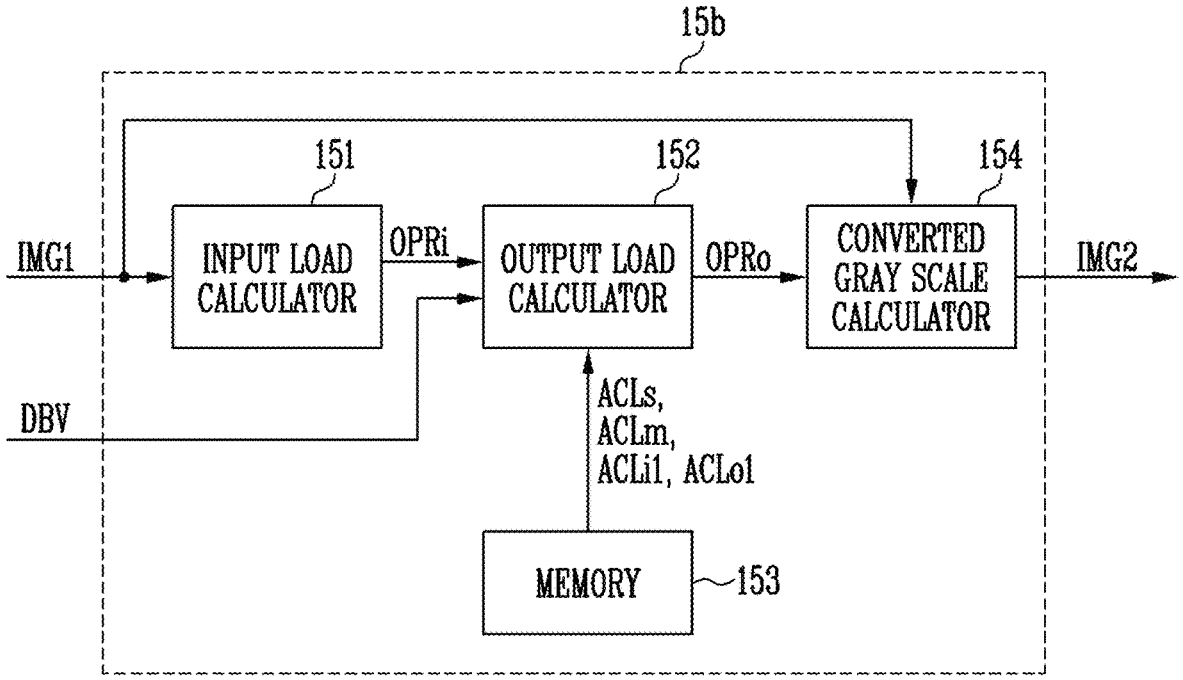
FIGS. 9 to 11 are diagrams illustrating a gray scale converter in accordance with one or more embodiments of the present disclosure.
Figure 10:
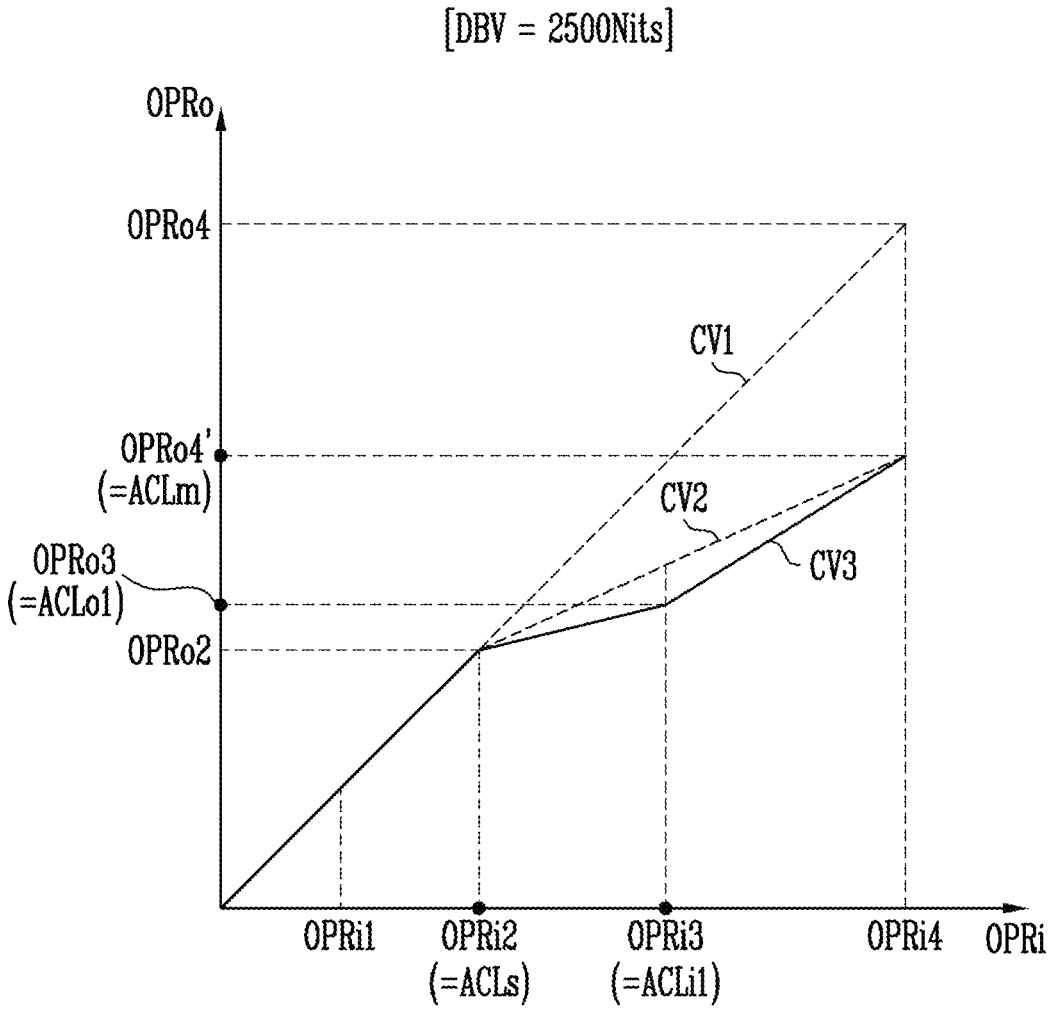
Figure 11:
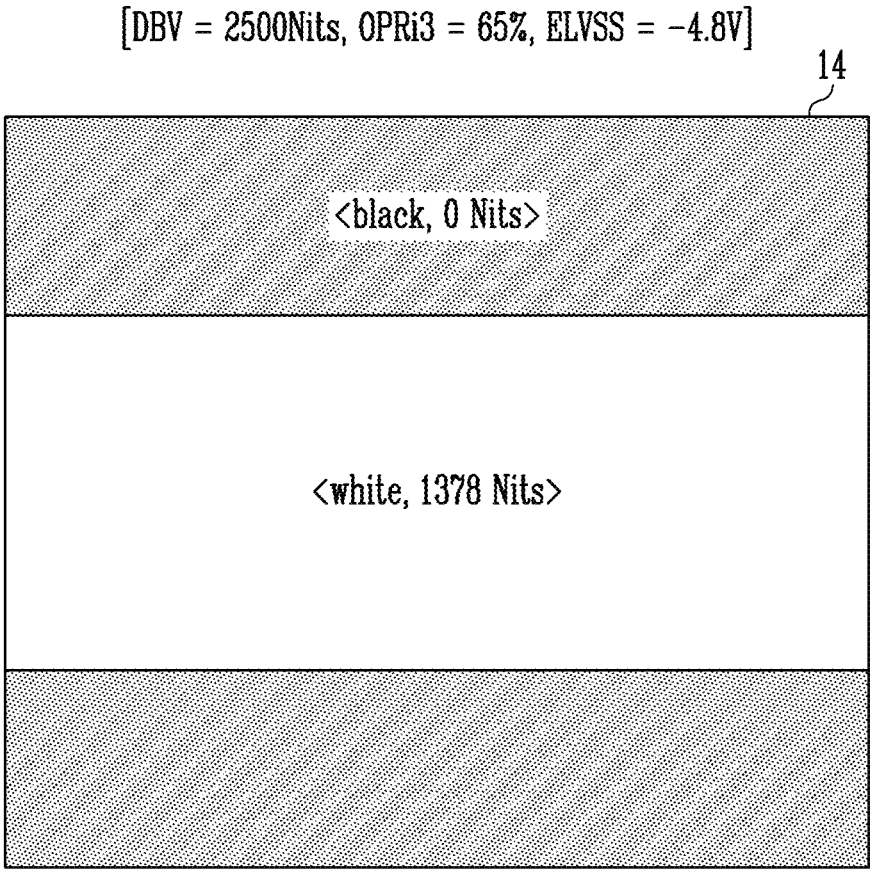

FIGS. 9 to 11 are diagrams illustrating a gray scale converter in accordance with one or more embodiments of the present disclosure.

Referring to FIG. 9, the gray scale converter 15*b* in accordance with one or more embodiments of the present disclosure may include an input load calculator 151, an output load calculator 152, a memory 153, and a converted gray scale calculator 154. Hereinafter, repeated description of configurations that are common to the gray scale converter 15*b* and the gray scale converter 15*a* will be omitted.

The memory 153 may store (e.g., previously store) the start current limit value ACLs, the first current limit value ACLi1, the first output load value ACLo1 corresponding to the first current limit value ACLi1, and the maximum output load value ACLm. The first current limit value ACLi1 may be larger than the start current limit value ACLs, and may be smaller than the maximum value OPRi4 of the input load value OPRi.

The output load calculator 152 may provide the same output load value OPRo as the input load value OPRi when the input load value OPRi is smaller than the start current limit value ACLs. The output load calculator 152 may provide the output load value OPRo for the input load value OPRi according to the third graph CV3 (see FIG. 10), when the input load value OPRi is larger than the start current limit value ACLs.

The output load calculator 152 may calculate the output load value OPRo corresponding to the input load value OPRi, by interpolating the first output load value ACLo1 and the output load value OPRo2 corresponding to the start current limit value ACLs, when the input load value OPRi is larger than the start current limit value ACLs and is smaller than the first current limit value ACLi1. When the input load value OPRi is larger than the start current limit value ACLs and is smaller than the first current limit value ACLi1, the increase rate of the output load value OPRo for the input load value OPRi may be a first increase rate.

The output load calculator may calculate the output load value OPRo corresponding to the input load value OPRi, by interpolating the first output load value ACLo1 and the maximum output load value ACLm, when the input load value OPRi is larger than the first current limit value ACLi1 and is smaller than the maximum value OPRi4 of the input load value OPRi. When the input load value OPRi is larger than the first current limit value ACLi1 and is smaller than the maximum value OPRi4 of the input load value OPRi, the increase rate of the output load value OPRo for the input load value OPRi may be a second increase rate. Here, the first increase rate and the second increase rate may be different from each other. For instance, the second increase rate may be greater than the first increase rate.

Referring to FIG. 11, when the maximum luminance value DBV is about 2500 Nits and the input load value OPRi3 is about 65%, the luminance value corresponding to the white gray scale value of the display area 14 may be about 1378 Nits. Here, the second power voltage ELVSS may be set to be about −4.8V. According to one or more embodiments, because other input load values OPRi1, OPRi2, and OPRi4 may use the second power voltage ELVSS of about −4.8V, unnecessary power consumption can be reduced or prevented. According to gathered statistics, because 65% is the input load value OPRi3 that may be the most frequently input to the display device 10, it may be very effective to previously store the first current limit value ACLi1 and the first output load value ACLo1 in the memory 153.

Figure 12:
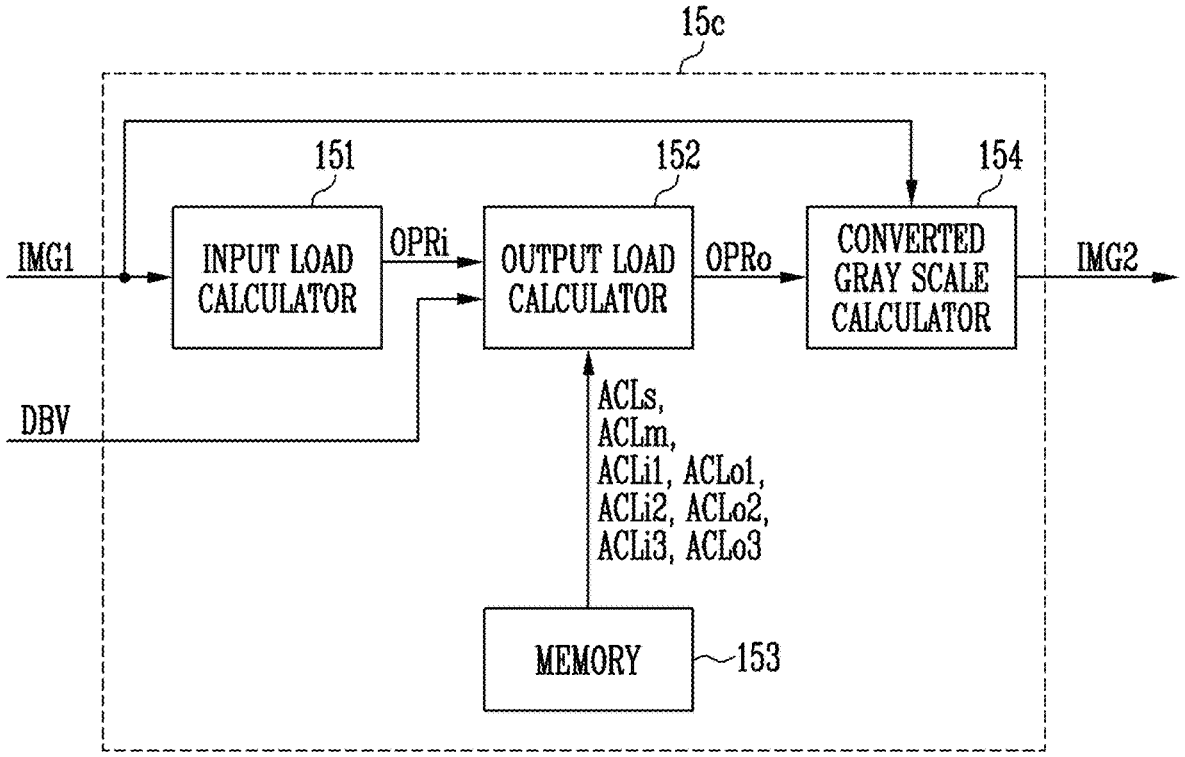
Figure 13:
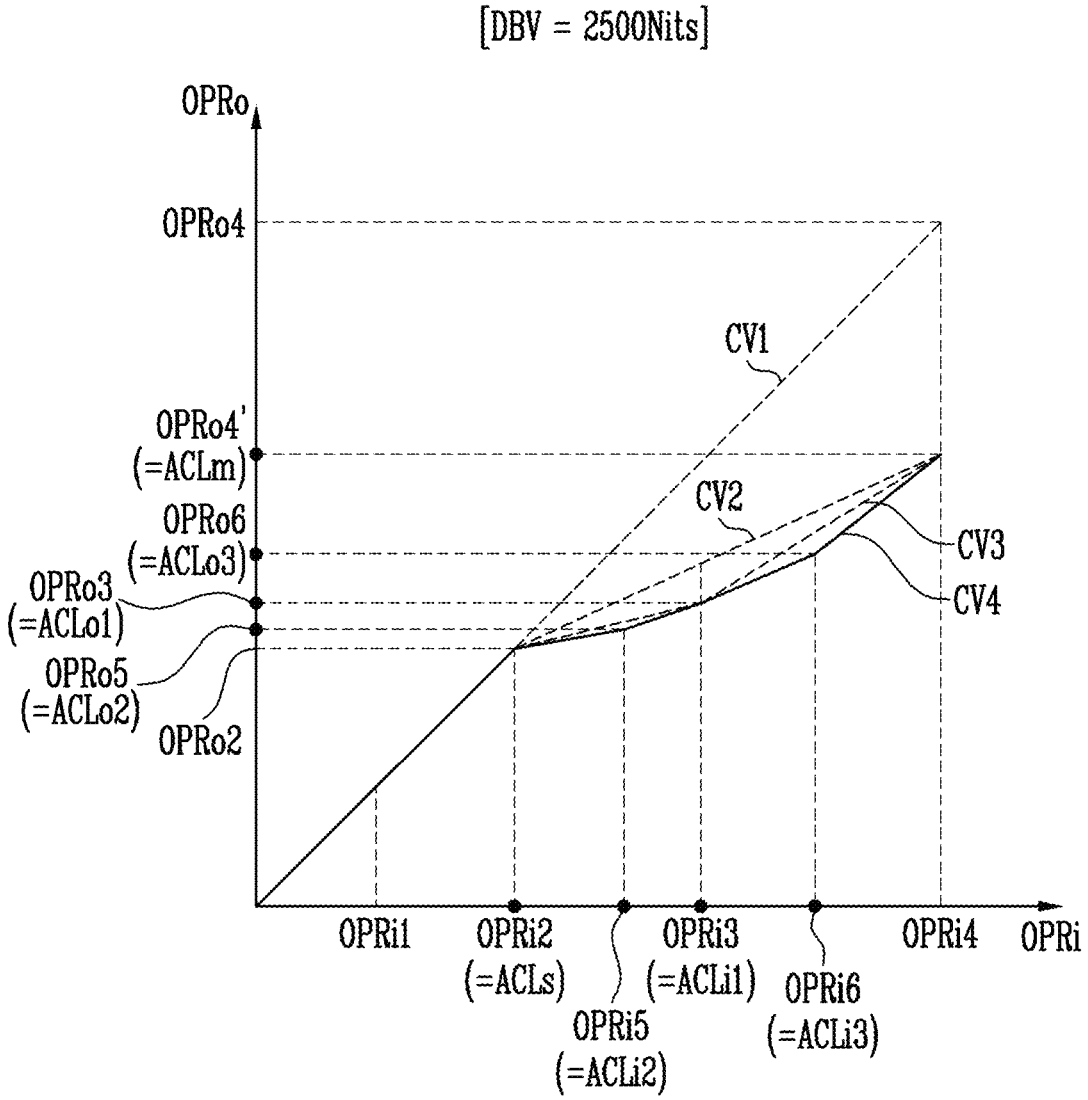

FIGS. 12 to 14 are diagrams illustrating a gray scale converter in accordance with one or more embodiments of the present disclosure.

Referring to FIG. 12, the gray scale converter 15*c* in accordance with one or more embodiments of the present disclosure may include an input load calculator 151, an output load calculator 152, a memory 153, and a converted gray scale calculator 154. Hereinafter, a repeated description of any configurations that are common to the gray scale converters 15*a*, 15*b*, and 15*c* will be omitted.

The memory 153 may previously store a start current limit value ACLs, a first current limit value ACLi1, a first output load value ACLo1 corresponding to the first current limit value ACLi1, a second current limit value ACLi2, a second output load value ACLo2 corresponding to the second current limit value ACLi2, a third current limit value ACLi3, a third output load value ACLo3 corresponding to the third current limit value ACLi3, and a maximum output load value ACLm. The second current limit value ACLi2 may be larger than the start current limit value ACLs and may be smaller than the first current limit value ACLi1. The first current limit value ACLi1 may be larger than the second current limit value ACLi2 and may be smaller than the third current limit value ACLi3. The third current limit value ACLi3 may be larger than the first current limit value ACLi1, and may be smaller than the maximum value OPRi4 of the input load value OPRi.

The output load calculator 152 may provide the same output load value OPRo as the input load value OPRi when the input load value OPRi is smaller than the start current limit value ACLs. The output load calculator 152 may provide the output load value OPRo for the input load value OPRi according to the fourth graph CV4, when the input load value OPRi is larger than the start current limit value ACLs.

The output load calculator 152 may calculate the output load value OPRo corresponding to the input load value OPRi, by interpolating the second output load value ACLo2 and the output load value OPRo2 corresponding to the start current limit value ACLs, when the input load value OPRi is larger than the start current limit value ACLs and smaller than the second current limit value ACLi2. When the input load value OPRi is larger than the start current limit value ACLs and smaller than the second current limit value ACLi2, the increase rate of the output load value OPRo for the input load value OPRi may be a third increase rate.

The output load calculator 152 may calculate the output load value OPRo corresponding to the input load value OPRi, by interpolating the second output load value ACLo2 and the first output load value ACLo1, when the input load value OPRi is larger than the second current limit value ACLi2 and smaller than the first current limit value ACLi1. When the input load value OPRi is larger than the second current limit value ACLi2 and smaller than the first current limit value ACLi1, the increase rate of the output load value OPRo for the input load value OPRi may be a fourth increase rate.

The output load calculator 152 may calculate the output load value OPRo corresponding to the input load value OPRi, by interpolating the third output load value ACLo3 and the first output load value ACLo1, when the input load value OPRi is larger than the first current limit value ACLi1 and smaller than the third current limit value ACLi3. When the input load value OPRi is larger than the first current limit value ACLi1 and smaller than the third current limit value ACLi3, the increase rate of the output load value OPRo for the input load value OPRi may be a fifth increase rate.

The output load calculator 152 may calculate the output load value OPRo corresponding to the input load value OPRi, by interpolating the third output load value ACLo3 and the maximum output load value ACLm, when the input load value OPRi is larger than the third current limit value ACLi3 and is smaller than the maximum value OPRi4 of the input load value OPRi. When the input load value OPRi is larger than the third current limit value ACLi3 and is smaller than the maximum value OPRi4 of the input load value OPRi, the increase rate of the output load value OPRo for the input load value OPRi may be a sixth increase rate. Here, the third increase rate, the fourth increase rate, the fifth increase rate, and the sixth increase rate may be different from each other.

Compared with the memory 153 of the gray scale converter 15*b* (see FIG. 9), the memory 153 of the gray scale converter 15*c* according to one or more embodiments may further store the second current limit value ACLi2 and the second output load value ACLo2 for the input load value OPRi5 of about 40%. Furthermore, the memory 153 of the gray scale converter 15*c* may further store the third current limit value ACLi3 and the third output load value ACLo3 for the input load value OPRi6 of about 80%. Thus, because more input load values OPRi5 and OPRi6 may use the second power voltage ELVSS of about −4.8V, unnecessary power consumption can be reduced or prevented. According to a test of the display device 10 of one or more embodiments, when configuring the memory 153, it may be possible to maintain the second power voltage ELVSS of about −4.8V at substantially all input load values OPRi.

Referring to the table of FIG. 14, when the maximum luminance value DBV is about 2500 Nits, in each graph CV1, CV2, or CV4, the values of saturation voltage Vsat used for exemplary input load values OPRi2, OPRi5, OPRi3, OPRi6, and OPRi4 are shown. The saturation voltage Vsat may be a maximum value of the second power voltage ELVSS for driving the driving transistors of the pixels in a saturated state, with respect to respective input load values OPRi2, OPRi5, OPRi3, OPRi6, and OPRi4. In other words, for the respective input load values OPRi2, OPRi5, OPRi3, OPRi6, and OPRi4, the second power voltage ELVSS that is smaller than the saturation voltage Vsat (e.g., smaller in magnitude) may be used to drive the pixels of the display area 14 in the saturated state.

Thus, it can be seen that the second power voltage ELVSS of about −7.5V may be used when the gray scale converter 15 generates the converted gray scale values IMG2 according to the first graph CV1. Furthermore, it can be seen that the second power voltage ELVSS of about −5.6V may be used when the gray scale converter 15*b* generates the converted gray scale values IMG2 according to the second graph CV2. Furthermore, it can be seen that the second power voltage ELVSS of about −4.8V may be used when the gray scale converter 15*c* generates the converted gray scale values IMG2 according to the fourth graph CV4. Therefore, it can be seen that the gray scale converter 15*c* may be most suitable in terms of power consumption reduction and driving stability.

Figure 15:
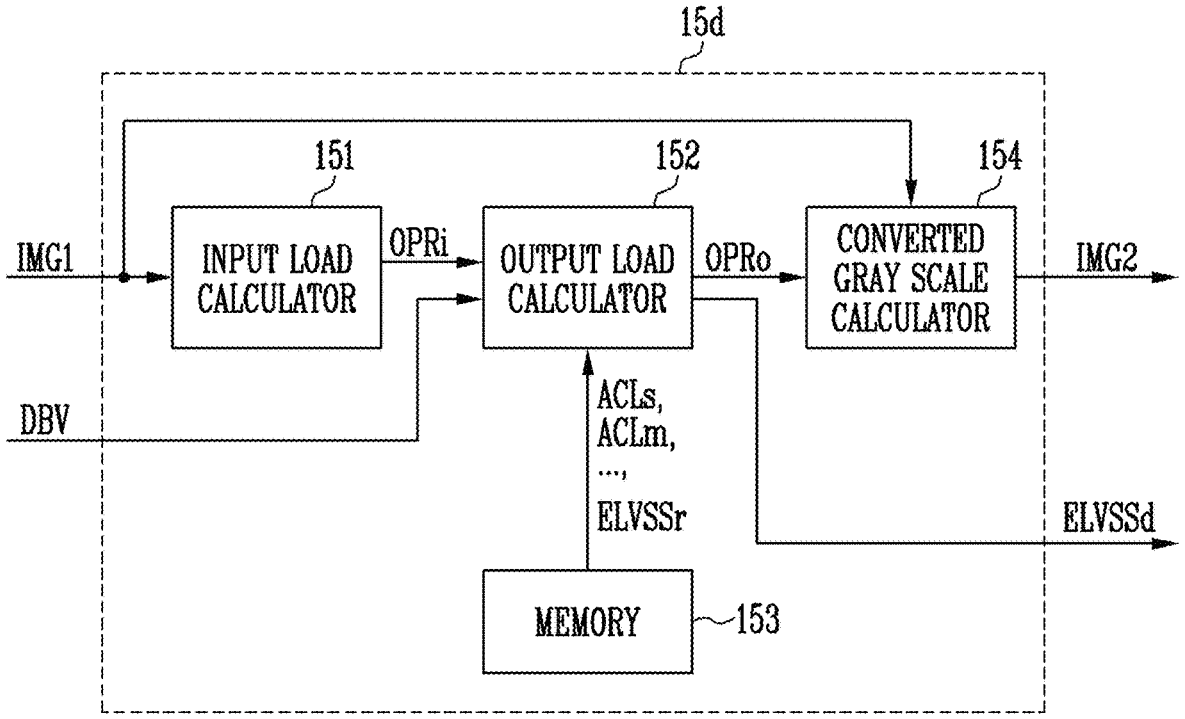

FIGS. 15 to 16 are diagrams illustrating a gray scale converter in accordance with one or more embodiments of the present disclosure.

Referring to FIG. 15, the gray scale converter 15*d* in accordance with one or more embodiments of the present disclosure may include an input load calculator 151, an output load calculator 152, a memory 153, and a converted gray scale calculator 154. Hereinafter, repeated description of any configurations common to the gray scale converters 15*a*, 15*b*, 15*c*, and 15*d* will be omitted.

The memory 153 may further store a reference power voltage value ELVSSr.

The output load calculator 152 may determine the magnitude of the second power voltage ELVSS, which is provided to the pixels in common, by providing a power voltage value ELVSSd corresponding to the maximum luminance value DBV.

For instance, the output load calculator 152 may determine the power voltage value ELVSSd by adding a power voltage offset value corresponding to the maximum luminance value DBV to the reference power voltage value ELVSSr. For instance, the output load calculator 152 may reduce the magnitude of the power voltage value ELVSSd as the maximum luminance value DBV increases. For instance, the output load calculator 152 may maintain the magnitude of the power voltage value ELVSSd, regardless of the increase or decrease in the input load value OPRi, as the maximum luminance value DBV is maintained.

Referring to FIG. 16, it is assumed that the reference power voltage value ELVSSr is set to about −3.8V in the maximum luminance value DBV of about 650 Nits. For instance, the output load calculator 152 may reduce the power voltage value ELVSSd from the reference power voltage value ELVSSr as the maximum luminance value DBV is larger than, or increases from, about 650 Nits. Furthermore, the output load calculator 152 may increase the power voltage value ELVSSd from the reference power voltage value ELVSSr as the maximum luminance value DBV is smaller than, or decreases from, about 650 Nits.

Meanwhile, as described above, the memory 153 of the gray scale converter 15*c* may previously store the maximum output load value ACLm when the input load value OPRi is about 100%, about 80%, about 65%, and about 40%, the third output load value ACLo3, the first output load value ACLo1, the second output load value ACLo2, etc. Referring to FIG. 16, for instance, the maximum output load value ACLm may be about 182.625, the third output load value ACLo3 may be about 185.375, the first output load value ACLo1 may be about 194.500, and the second output load value ACLo2 may be about 220.250.

According to one or more embodiments, the memory 153 may previously store various pieces of data described in the table of FIG. 16. As the memory 153 stores more data, the second power voltage ELVSS may be more efficiently provided. However, because the manufacturing cost and tact time of the memory 153 may increase, proper selection may be appropriate depending on the product and other considerations.

Figure 17:
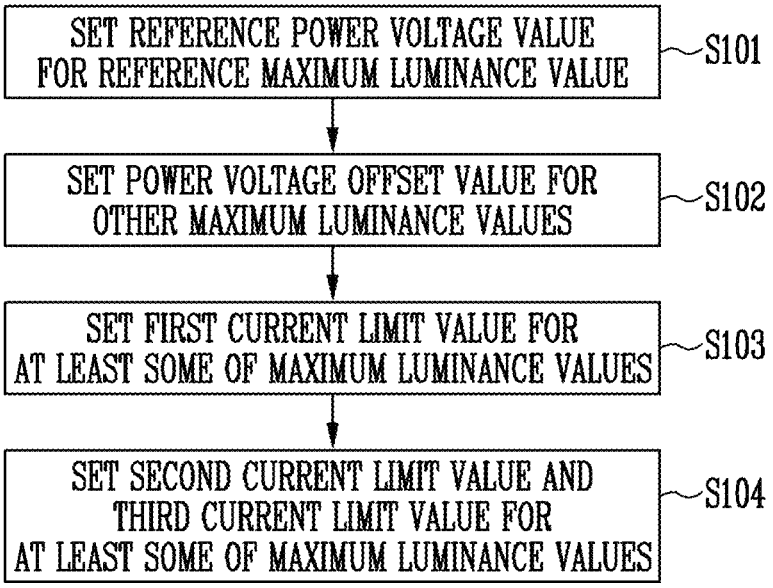
FIG. 17 is a diagram illustrating a sequence of storing data in a memory in accordance with one or more embodiments of the present disclosure.

FIG. 17 is a diagram illustrating a sequence of storing data in a memory in accordance with one or more embodiments of the present disclosure.

Referring to FIG. 17, data may be stored in the memory 153 before the display device 10 is shipped.

First, the reference power voltage value ELVSSr for the reference maximum luminance value may be set at S101. For instance, the reference maximum luminance value may be about 650 Nits at S101.

Next, power voltage offset values for other maximum luminance values may be set at S102. For instance, when the maximum luminance value DBV is greater than the reference maximum luminance value, the power voltage offset value may be relatively small. Here, the power voltage offset values may be less than 0. Furthermore, when the maximum luminance value DBV is smaller than the reference maximum luminance value, the power voltage offset value may be relatively large. Here, the power voltage offset values may be greater than 0.

Next, the first current limit value ACLi1 for at least some of the maximum luminance values may be set at S103. As described above, the input load value OPRi3 of about 65%, which way me net most frequently used as indicated by statistics, may be set as the first current limit value ACLi1. Furthermore, the first output load value ACLo1 corresponding to the first current limit value ACLi1 may be set. Here, the first output load value ACLo1 corresponding to the first current limit value ACLi1 may be precisely set using an external device, such as a camera or a luminance measuring device. According to the first output load value ACLo1 that is set, unnecessary power consumption and/or unstable image display may be reduced or prevented even if the preset reference power voltage value ELVSSr and the power voltage offset values are used.

Next, the second current limit value ACLi2 and the third current limit value ACLi3 for at least some of the maximum luminance values may be set at S104. Furthermore, the second output load value ACLo2 corresponding to the second current limit value ACLi2 may be set. Furthermore, the third output load value ACLo3 corresponding to the third current limit value ACLi3 may be set. To reduce the tact time at S104, calculation may be made through the operation of a processor without using an external device such as a camera or a luminance measuring device.

At least some of the data calculated in the process of FIG. 17 may be stored in the memory 153. For reference, after the process of FIG. 17, a process for setting the data voltage corresponding to the black gray scale and the data voltages corresponding to other gray scale values may be performed.

Accordingly, as described above, a display device in accordance with the present disclosure can stably provide an image of ultra-high luminance.

The detailed description of the disclosure described with reference to the drawings is merely illustrative, which is used only for the purpose of describing the disclosure and is not used to limit the meaning or scope of the disclosure as defined in the accompanying claims. Therefore, those skilled in the art will understand that various modifications and equivalences thereof are possible. Accordingly, the bounds and scope of the present invention should be determined by the technical spirit of the following claims with the functional equivalents thereof to be included therein.

What is claimed is:

1. A display device comprising:

pixels;

a gray scale converter configured to:

receive input gray scale values for the pixels;

calculate an output load value that is smaller than an input load value when the input load value calculated from the input gray scale values is larger than a start current limit value;

convert the input gray scale values into converted gray scale values to correspond to the output load value; and reduce a magnitude of a low-potential power voltage that is supplied to the pixels in common as a maximum luminance value increases; and a data driver configured to provide data voltages based on the converted gray scale values to the pixels, wherein, when the input load value is larger than the start current limit value and is smaller than a first current limit value, an increase rate of the output load value for the input load value is a first increase rate, and wherein, when the input load value is larger than the first current limit value and is smaller than a maximum value of the input load value, an increase rate of the output load value for the input load value is a second increase rate that is different than the first increase rate.

2. The display device according to claim 1, wherein the gray scale converter is further configured to receive the maximum luminance value, and to determine a magnitude of the output load value corresponding to the input load value based on a magnitude of the maximum luminance value.

3. The display device according to claim 2, wherein the gray scale converter is further configured to determine that the larger the maximum luminance value is, the smaller the output load value corresponding to the input load value is.

4. The display device according to claim 3, wherein the gray scale converter is configured to maintain the magnitude of the low-potential power voltage, regardless of an increase or decrease in the input load value, when the maximum luminance value is maintained.

5. The display device according to claim 1, wherein the gray scale converter comprises a memory that is configured to store the start current limit value, the first current limit value, a first output load value corresponding to the first current limit value, and a maximum output load value.

6. The display device according to claim 5, wherein the gray scale converter further comprises an output load calculator that is configured to calculate the output load value corresponding to the input load value, by interpolating the output load value corresponding to the start current limit value and the first output load value, when the input load value is larger than the start current limit value and is smaller than the first current limit value.

7. The display device according to claim 6, wherein the output load calculator is further configured to calculate the output load value corresponding to the input load value, by interpolating the first output load value and the maximum output load value, when the input load value is larger than the first current limit value and is smaller than the maximum value of the input load value.

8. The display device according to claim 7, wherein the output load calculator is further configured to determine that the larger a maximum luminance value is, the smaller the output load value corresponding to the input load value is.

9. The display device according to claim 8, wherein the gray scale converter further comprises a converted gray scale calculator that is configured to:

convert the input gray scale values into the converted gray scale values to correspond to the output load value; and convert the converted gray scale values to be smaller than or equal to the output load value.

10. A display device comprising:

pixels;

a gray scale converter configured to:

receive input gray scale values for the pixels;

calculate an output load value that is smaller than an input load value when the input load value calculated from the input gray scale values is larger than a start current limit value;

convert the input gray scale values into converted gray scale values to correspond to the output load value; and reduce a magnitude of a low-potential power voltage that is supplied to the pixels in common as a maximum luminance value increases; and a data driver configured to provide data voltages based on the converted gray scale values to the pixels, wherein, when the input load value is larger than the start current limit value and is smaller than a second current limit value, an increase rate of the output load value for the input load value is a third increase rate, wherein, when the input load value is larger than the second current limit value and is smaller than a first current limit value, an increase rate of the output load value for the input load value is a fourth increase rate, wherein, when the input load value is larger than the first current limit value and is smaller than a third current limit value, an increase rate of the output load value for the input load value is a fifth increase rate, wherein, when the input load value is larger than the third current limit value and is smaller than a maximum value of the input load value, an increase rate of the output load value for the input load value is a sixth increase rate, and wherein the third increase rate, the fourth increase rate, the fifth increase rate, and the sixth increase rate are different from each other.

11. The display device according to claim 10, wherein the gray scale converter comprises a memory that is configured to store the start current limit value, the first current limit value, a first output load value corresponding to the first current limit value, a second output load value corresponding to the second current limit value, a third output load value corresponding to the third current limit value, and a maximum output load value.

12. The display device according to claim 11, wherein the gray scale converter further comprises an output load calculator that is configured to calculate the output load value corresponding to the input load value, by interpolating the output load value corresponding to the start current limit value and the second output load value, when the input load value is larger than the start current limit value and is smaller than the second current limit value.

13. The display device according to claim 12, wherein the output load calculator is configured to calculate the output load value corresponding to the input load value by:

interpolating the second output load value and the first output load value when the input load value is larger than the second current limit value and is smaller than the first current limit value;

interpolating the first output load value and the third output load value when the input load value is larger than the first current limit value and is smaller than the third current limit value; and interpolating the third output load value and the maximum output load value when the input load value is larger than the third current limit value and is smaller than the maximum value of the input load value.

14. The display device according to claim 13, wherein the output load calculator is configured to determine that the larger the maximum luminance value is, the smaller the output load value corresponding to the input load value is.

15. The display device according to claim 14, wherein the gray scale converter further comprises a converted gray scale calculator that is configured to:

convert the input gray scale values into the converted gray scale values to correspond to the output load value; and convert the converted gray scale values to be smaller than or equal to the output load value.

16. The display device according to claim 14, wherein the memory is further configured to store a reference power voltage value.

17. The display device according to claim 16, wherein the output load calculator is configured to determine:

the magnitude of the low-potential power voltage that is provided to the pixels in common by providing a low-potential power voltage value corresponding to the maximum luminance value; and the low-potential power voltage value by adding a power voltage offset value corresponding to the maximum luminance value to the reference power voltage value.

18. The display device according to claim 17, wherein the output load calculator is configured to maintain the magnitude of the low-potential power voltage, regardless of an increase or decrease in the input load value, when the maximum luminance value is maintained.

* * * * *